US007902479B2

(12) United States Patent
Tsuchiya et al.

(10) Patent No.: US 7,902,479 B2
(45) Date of Patent: Mar. 8, 2011

(54) VACUUM SWITCHGEAR

(75) Inventors: Kenji Tsuchiya, Hitachi (JP); Makoto Yano, Mito (JP); Ayumu Morita, Hitachi (JP); Takashi Sato, Mito (JP); Masato Kobayashi, Hitachi (JP); Tomoaki Utsumi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 346 days.

(21) Appl. No.: 11/762,482

(22) Filed: Jun. 13, 2007

(65) Prior Publication Data

US 2007/0228014 A1 Oct. 4, 2007

(30) Foreign Application Priority Data

Feb. 22, 2005 (JP) ..... 2005-045656

(51) Int. Cl.
*H01H 33/66* (2006.01)

(52) U.S. Cl. ..... 218/120; 218/7; 218/154

(58) Field of Classification Search ..... 218/118–120, 218/134, 139, 140, 153–155, 7, 10, 9, 14
See application file for complete search history.

(56) References Cited

U.S. PATENT DOCUMENTS

| | | | | |
|---|---|---|---|---|
| 3,955,167 | A * | 5/1976 | Kumbera | 218/118 |
| 6,881,917 | B2 * | 4/2005 | Kikukawa et al. | 218/120 |
| 6,897,396 | B2 * | 5/2005 | Ito et al. | 218/120 |
| 2004/0222192 | A1 | 11/2004 | Kikukawa et al. | |

FOREIGN PATENT DOCUMENTS

| | | |
|---|---|---|
| EP | 543 352 | 11/1992 |
| EP | 147 169 | 10/2000 |
| EP | 1 150 405 | 10/2001 |
| EP | 1 383 148 | 1/2004 |
| JP | 2000-268685 | 9/2000 |
| JP | 2003-333715 | 11/2003 |
| WO | WO00/69041 | 11/2000 |

* cited by examiner

*Primary Examiner* — Renee Luebke
*Assistant Examiner* — Marina Fishman
(74) *Attorney, Agent, or Firm* — Mattingly & Malur, P.C.

(57) ABSTRACT

A reliable, compact vacuum switchgear is provided at an inexpensive cost. The vacuum switchgear comprises a switch 1 having a fixed electrode 12 and a movable electrode 13 connectable to and disconnectable from the fixed electrode 12, another switch 2 having a fixed electrode 22 and a movable electrode 23 connectable to and disconnectable from the fixed electrode 22, conductors 3 connected to the fixed electrodes 12, 22 of the switches 1, 2, earth switches 4 connected to the conductors 3, a mold section 7 formed by molding the conductors 3 and the earth switches 4 with resin, and a vacuum container 8 accommodating the switches 1, 2 and disposed on the mold section 7.

11 Claims, 9 Drawing Sheets

VACUUM SWITCHGEAR

BACKGROUND OF THE INVENTION

1. Field of the Invention

The present invention relates to a vacuum switchgear used in a power receiving and distribution apparatus that receives power from a bus and distributes the received power to various types of electric devices, a cubicle-type insulated switching apparatus, or the like.

2. Prior Art

A power receiving and distribution apparatus that receives power from a bus and distributes the received power to various types of electric devices, for example, accommodates in a container bus-side conductors connected to the bus, load-side conductors connected to loads, a main circuit switch for connecting the bus-side conductors to the load-side conductors and disconnecting them from the load-side conductors, and ground switches for grounding the load side conductors.

In an exemplary power receiving and distribution apparatus of this type, the above devices etc. are disposed in a superiorly insulated container under vacuum in order to reduce the size of the apparatus and increase the stability of installation, as disclosed in Patent Document 1.

In another power receiving and distribution apparatus, its main circuit switch is configured as a vacuum valve, and the vacuum valve and devices connected to it are molded with epoxy resin or another insulating material in order to reduce the number of parts to be assembled and improve an installation thereof, as disclosed in Patent Document 2.

Patent Document 1: Japanese Application Patent Laid-open Publication No. 2000-268685

Patent Document 2: Japanese Application Patent Laid-open Publication No. 2003-333715

SUMMARY OF THE INVENTION

Vacuum switchgears as described above are required to be highly reliable, compact, and inexpensive. To meet these requirements, various switchgears as described in Patent Documents 1 and 2 above are proposed.

Reliability as well as compactness and inexpensiveness of the vacuum switchgear are mutually conflicting requirements. Specifically, if an attempt is made to further increase the reliability (safety), expensive material have to be used, resulting in a high cost. Consequently, the problem with the compactness and inexpensiveness is not solved. If an emphasis is placed on compactness and inexpensiveness, the quality is lowered and the reliability may be sacrificed. The vacuum switchgear described in Patent Document 1 is designed to meet the conflicting requirements for reliability as well as compactness and inexpensiveness. However, epoxy resin or another insulating material used for molding may be exposed to a severe environment, in which case deterioration by aging is unavoidable.

If the insulating material such as epoxy resin is deteriorated as described above, its insulating property is lowered, possibly causing a ground fault. To prevent the ground fault, the insulating material has to be thick enough to withstand years of service. This increases the amount of insulating material used, resulting in a high cost. Vacuum switchgears at present still need improvement in terms of reliability, compactness, and inexpensiveness.

The present invention addresses the problems described above with the object of providing a compact, inexpensive vacuum switchgear having a further improved reliability.

To achieve the above object, a vacuum switchgear according to an aspect of the present invention has a mold section to which conductors connected to fixed electrodes of switches are molded with resin and includes a vacuum container, disposed on the mold section, that accommodates the switches, each of which comprises the fixed electrode and a movable electrode connectable to and disconnectable from the fixed electrode.

A vacuum switchgear according to another aspect of the present invention has a mold section to which ground switches and conductors connected to fixed electrodes of switches are molded with resin and includes a vacuum container, disposed on the mold section, that accommodates the switches, each of which comprises the fixed electrode and a movable electrode connectable to and disconnectable from the fixed electrode.

A vacuum switchgear according to still another aspect of the present invention has a mold section to which ground switches and conductors connected to fixed electrodes of switches that function as a circuit breaker and load break switches are molded with resin and includes a vacuum container, disposed on the mold section, that accommodates the circuit breaker and load break switches, each of which comprises the fixed electrode and a movable electrode connectable to and disconnectable from the fixed electrode.

A vacuum switchgear according to yet another aspect of the present invention has a mold section to which ground switches and conductors connected to fixed electrodes of switches that function as a circuit breaker and disconnecting switches are molded with resin and includes a vacuum container, disposed on the mold section, that accommodates the circuit breaker and disconnecting switches, each of which comprises the fixed electrode and a movable electrode connectable to and disconnectable from the fixed electrode.

According to the present invention, the mold resin member used as the main insulator between the main circuit and ground can be localized near the conductors connected to the fixed electrodes, which significantly reduces the amount of resin used. Furthermore, the spacing between the main circuit section in the vacuum container and ground is isolated doubly by vacuum and the resin member or air, increasing the insulation reliability.

DETAILED DESCRIPTION OF THE INVENTION

Embodiments of a vacuum switchgear according to the present invention will be described with reference to the drawings.

Figure 1:
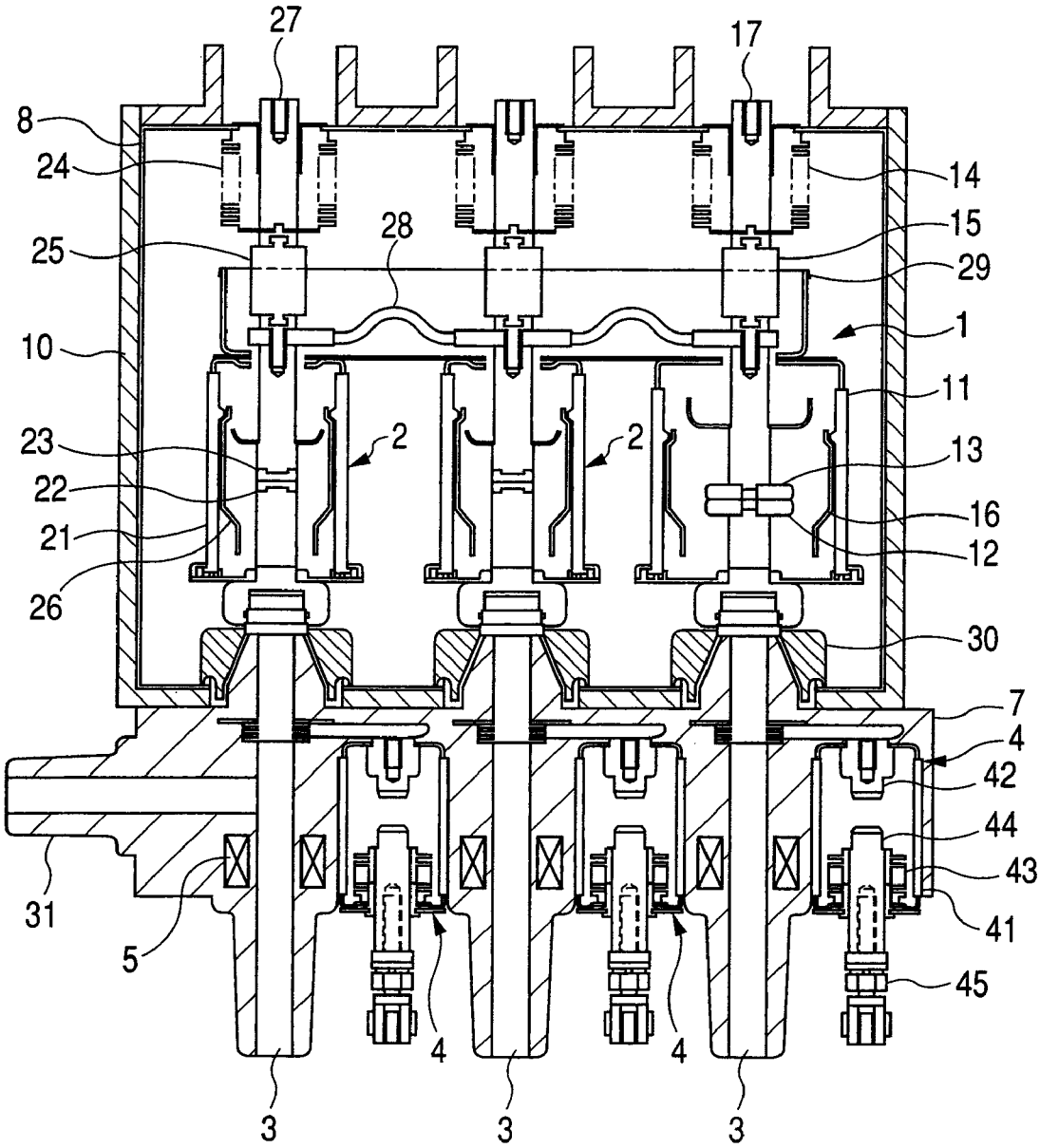
FIG. 1 is a longitudinal front view illustrating an embodiment of the inventive vacuum switchgear.
Figure 2:
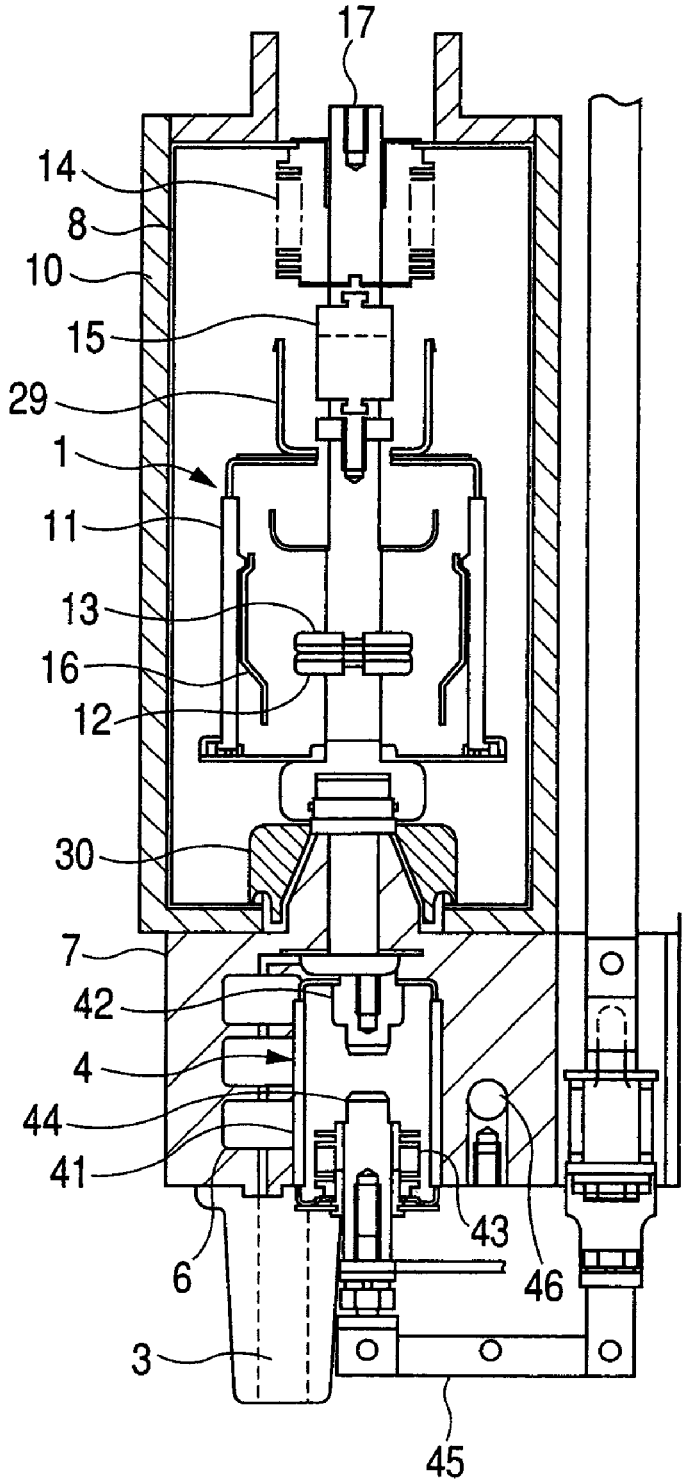
FIG. 2 is a longitudinal side view of the embodiment of the inventive vacuum switchgear shown in FIG. 1.
Figure 3:
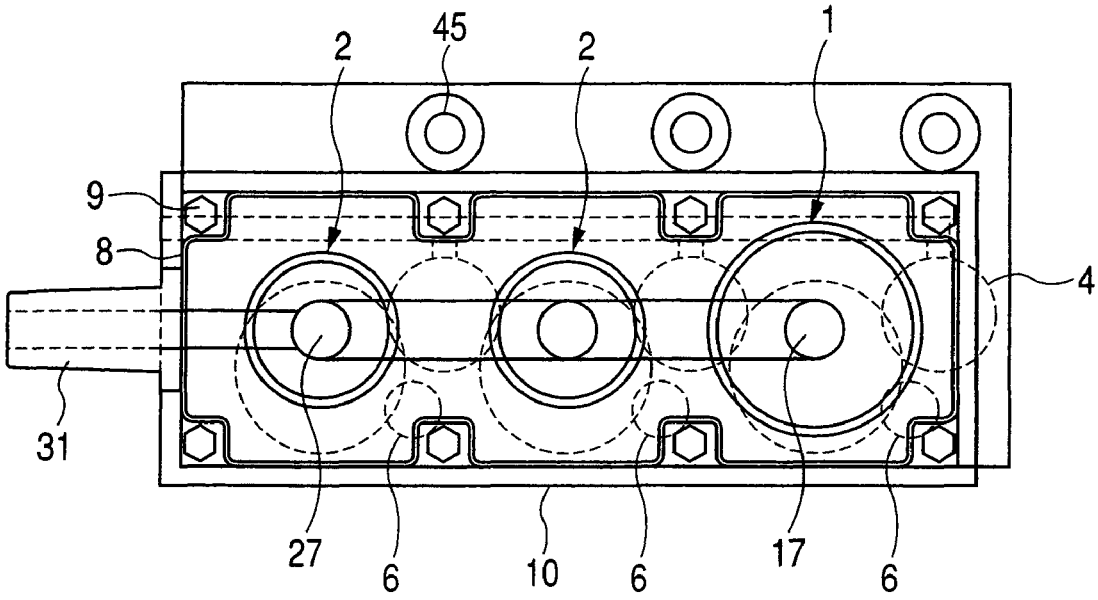
FIG. 3 is a plan view of the embodiment of the inventive vacuum switchgear shown in FIG. 1.
Figure 4:
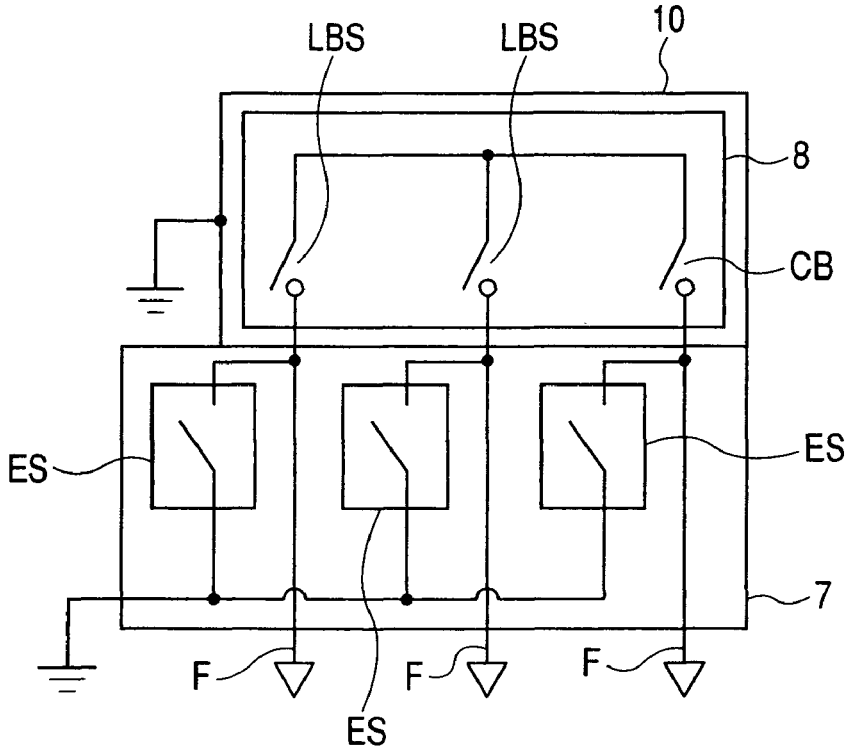
FIG. 4 is an electric schematic circuit diagram of a ring main unit configured in the embodiment of the inventive vacuum switchgear.

FIGS. 1 to 4 illustrate an embodiment of a vacuum switchgear according to the present invention. FIG. 1 is a longitudinal front view illustrating the embodiment of the inventive vacuum switchgear. FIG. 2 is a longitudinal side view of the embodiment of the inventive vacuum switchgear shown in FIG. 1. FIG. 3 is a plan view of the embodiment of the inventive vacuum switchgear shown in FIG. 1. FIG. 4 is an electric schematic circuit diagram of a ring main unit configured in the embodiment of the inventive vacuum switchgear.

First, the ring main unit in FIG. 4 generally comprises a vacuum switch which is constituted a circuit breaker (CB), two load break switches (LBSs), earth switches (ESS), and feeder conductors (Fs) connected to each of the fixed electrodes of the circuit breaker (CB) and the two load break switches (LBSs). The feeder conductors (Fs) and earth switches (ESs) are molded with resin. A vacuum container 8 is placed on the mold section 7. The vacuum container 8 includes the circuit breaker (CB) and the two load break switches (LBSs). The outer periphery or surface of the vacuum container 8 is covered by a insulating mold case 10 with resin.

An embodiment of the inventive vacuum switchgear that constitutes the above ring main unit will be described in detail with reference to FIGS. 1 to 3.

The vacuum switch is constituted a circuit breaker (CB) 1, two load break switches (LBSs) 2, feeder conductors (Fs) 3 connected to each of the fixed electrodes 22 of the circuit breaker (CB) 1 and the two load break switches (LBSs) 2, and earth switches (ESs) 4 connected to the feeder conductors 3. Current transformers 5 and voltage dividers 6 which are being provided on the feeder conductors 3, are molded with resin and constitute the mold section 7, as shown in FIGS. 1 and 2. The earth switch 4 has a solid insulating tube 41 made of, for example, ceramic and kept under vacuum, a fixed electrode 42 fixed at the upper part of the solid insulating tube 41 and connected to the feeder conductor 3, and a movable electrode 44 disconnectably connected to the fixed electrode 42 at the lower part of the solid insulating tube 41 through a bellows 43. The movable electrode 44 of the earth switch 4 is made movable by an earth switch opening/closing mechanism 45 that comprises a rod, a link, and the like. The movable electrode 44 of the earth switch 4 is connected to an earth bus 46.

A vacuum container 8 made of stainless or another material is fixed on the mold section 7 by bolts 9 shown in FIG. 3. The outer periphery or surface of the vacuum container 8 is molded by the insulating mold case 10 with a thermosetting molding material 10*a* such as unsaturated polyester resin.

The circuit breaker 1 disposed in the vacuum container 8 has an insulating tube 11, a fixed electrode 12, a movable electrode 13, an insulating rod 15 and an arc shield 16 disposed on the inner surface of the insulating tube 11; the fixed electrode 12 is fixed in the insulating tube 11 and connected to the feeder conductor 3 brought into the vacuum container 8; the movable electrode 13 is brought into the insulating tube 11 and can be connected to and disconnected from the fixed electrode 12; the insulating rod 15 is connected to the movable electrode 13 through a bellows 14. The insulating rod 15 for the circuit breaker is connected to a circuit breaker opening/closing mechanism 17 that comprises a rod, a link, and the like. The bellows 14 has a bag shape and has less sealing portions, increasing the reliability for vacuum hermeticity.

The load break switch 2 disposed in the vacuum container 8 has an insulating tube 21, a fixed electrode 22, a movable electrode 23, an insulating rod 25 and an arc shield 26 disposed on the inner surface of the insulating tube 21; the fixed electrode 22 is fixed in the insulating tube 21 and connected to the feeder conductor 3 brought into the vacuum container 8; the movable electrode 23 is brought into the insulating tube 21 and can be connected to and disconnected from the fixed electrode 22; the insulating rod 25 is connected to the movable electrode 23 through a bellows 24.

As with the above bellows 14, the bellows 24 has a bag shape and has less sealing portions, increasing the reliability for vacuum hermeticity. The insulating rod 25 for the load break switch is connected to a load break switch opening/closing mechanism 27 that comprises a rod, a link, and the like.

The movable electrode 13 for the circuit breaker 1 and one of the movable electrodes 23 for the load break switch 2 are interconnected by a flexible conductor 28, and that movable electrode 23 for the load break switch 2 and the other movable electrode 23 for the load break switch 2 are also interconnected by another flexible conductor 28. The flexible conductor 28 is provided with a flexible conductor shield 29. The flexible conductor 28 is fixed to the movable electrodes 13, 23 by screwing and brazing. When the moving electrode 13, 23 moves, the flexible conductor 28 generates a return force in the lateral direction in FIG. 1, since the flexible conductor 28 is fixed by screws to resist to the return force, so that work involved in the brazing is simplified.

Each feeder conductor 3 brought into the vacuum container 8 is supported by the vacuum container 8 through a solid insulator 30 made of, for example, ceramic. A side of each of the feeder conductors 3 opposite to its fixed electrode is a cable connection terminal 31.

Next, the operation of an embodiment of the inventive vacuum switchgear will be described in detail with reference to FIGS. 1 to 3.

In the circuit breaker 1, the circuit breaker opening/closing mechanism 17 is operated according to a detection signal for an overcurrent, shortcircuit, ground fault, or other failure that is detected on the load side by a detecting means. The movable electrode 13 is then disconnected from the fixed electrode 12 to open the connection circuit.

Each of the load break switches 2 is operated by the load break switch opening/closing mechanism 27. The movable electrode 23 is then disconnected from the fixed electrode 22 to disconnect the connection circuit. This embodiment uses a phase separation construction. For three phases, another unit construction described above may be provided.

Since the vacuum container 8 is disposed on the mold section 7, the vacuum container is maintained in a floating voltage state, increasing the insulation performance of the vacuum container 8 with respect to the ground. This reduces the probability of ground faults and improves reliability.

In parts at which vacuum sealing is not necessary, such as the solid insulating tube 41 of the earth switch 4, swaging or ceramic metallization by use of an active brazing material is eliminated, which enables the use of inexpensive ceramic and reduces the manufacturing cost. In the mold section 7, the feeder conductors 3, earth switches 4, current transformers 5, and voltage dividers 6 are molded, so the mold section 7 is compact as compared with the entire vacuum switchgear, which also contributes to the reduction in the manufacturing cost.

The earth switches 4 are disposed in the mold section 7, which is outside the vacuum container 8, so the weight and capacity of the vacuum container 8 can be reduced, which significantly reduces the size of the vacuum container 8 having the circuit breaker 1 and load break switches 2 and greatly cuts down the cost. Even if a ground fault occurs in the earth switch 4, the ground fault current is automatically shut down within one cycle by highly vacuum tight arc-suppressing performance, suppressing the ground fault from spreading.

According to the above embodiment of the present invention, the vacuum container 8 including the circuit breaker 1 and load break switches 2 is disposed on the mold section 7, so the electric potential of the vacuum container 8 is a floating voltage that is approximately equal to the ground potential, thereby increasing the safety and reliability of the vacuum container 8 against ground faults.

The earth switches 4 disposed outside the vacuum container 8, that is, in the mold section 7, so the structures of the circuit breaker 1, the load break switches 2 and the like in the vacuum container 8 can be simplified, and the vacuum container can be made compact.

In addition, the feeder conductors 3 are part of the integrated mold section 7, so its molding cost can be reduced and thereby the entire manufacturing cost can also be reduced.

Although the earth switches 4 are disposed outside the vacuum container 8 in the above embodiment, it is also possible to dispose them in the vacuum container 8. Even in this case, the electric potential of the vacuum container 8 can be reduced nearly to the ground potential as in the above embodiment, and the safety and reliability of the vacuum container 8 against ground faults can be increased.

In the above embodiment, the thermosetting molding material 10*a* provided on the outer periphery or surface of the vacuum container 8 such as unsaturated polyester resin is further used to prevent ground faults. Owing to the use of the thermosetting molding material 10*a*, withstanding the operation voltage for a half cycle is sufficiently in the unlikely event of a discharge between a conductor and the vacuum container 8. It is also possible to coat conductive paint to the inner surface of the thermosetting molding material 10*a* to prevent corona discharges generated due to small gaps between the vacuum container 8 and thermosetting molding material 10*a*. Instead of using the thermosetting molding material 10*a*, a metallic cover may be provided with a spacing from the vacuum container 8 that is just enough to withstand the operation voltage.

Figure 5:
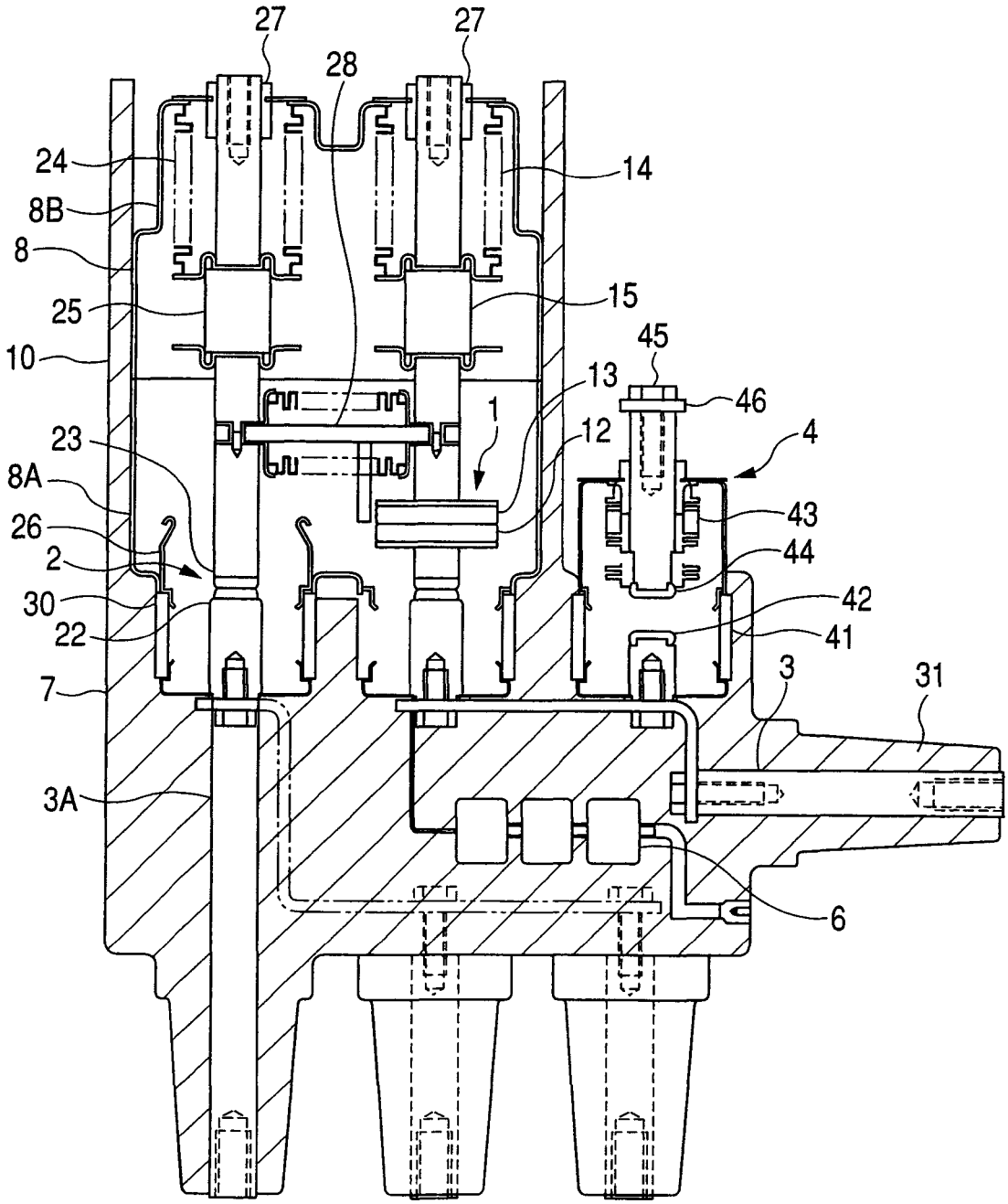
FIG. 5 is a longitudinal front view illustrating another embodiment of the inventive vacuum switchgear.
Figure 6:
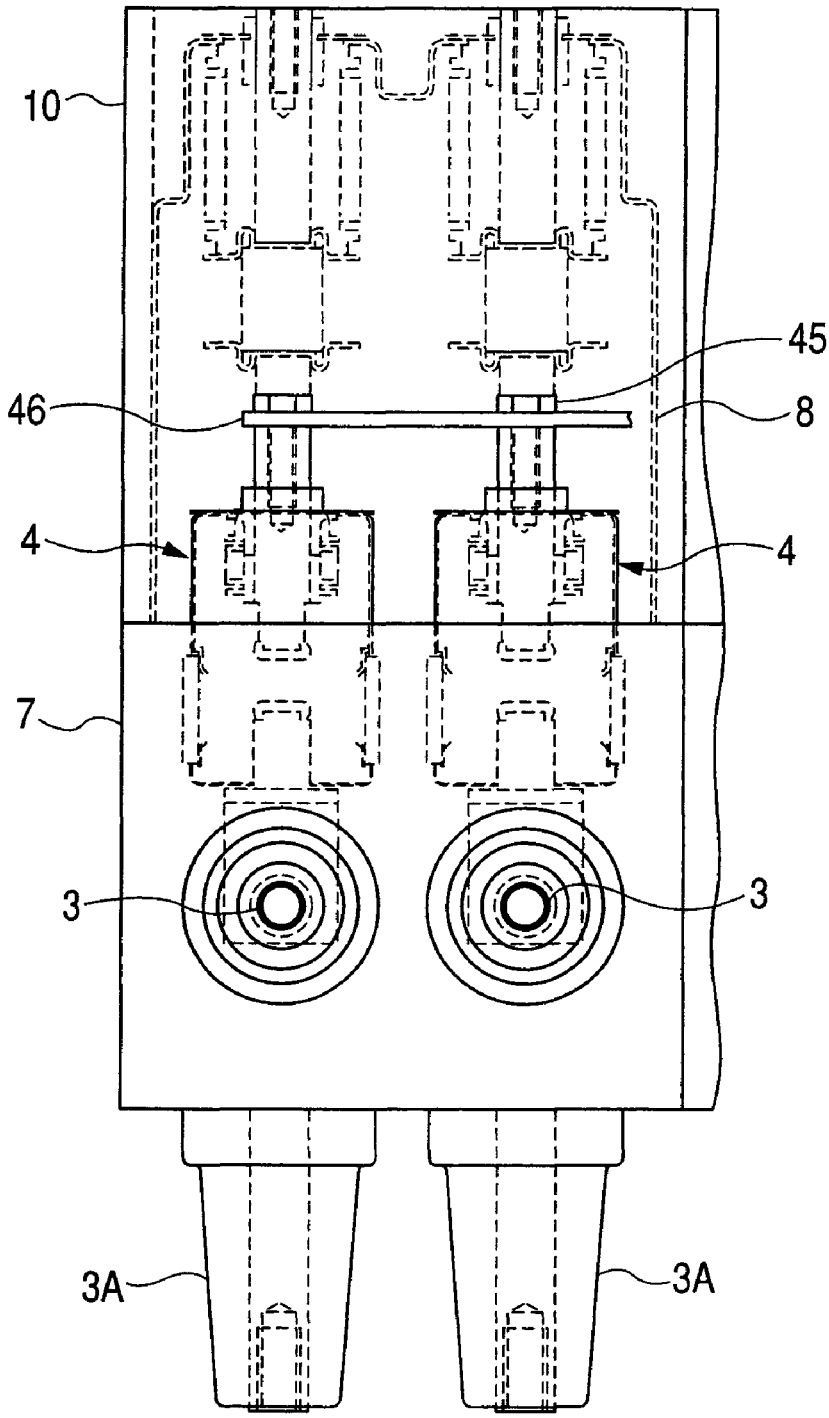
FIG. 6 is a side view in which part of the other embodiment of the inventive vacuum switchgear shown in FIG. 1 is omitted.
Figure 7:
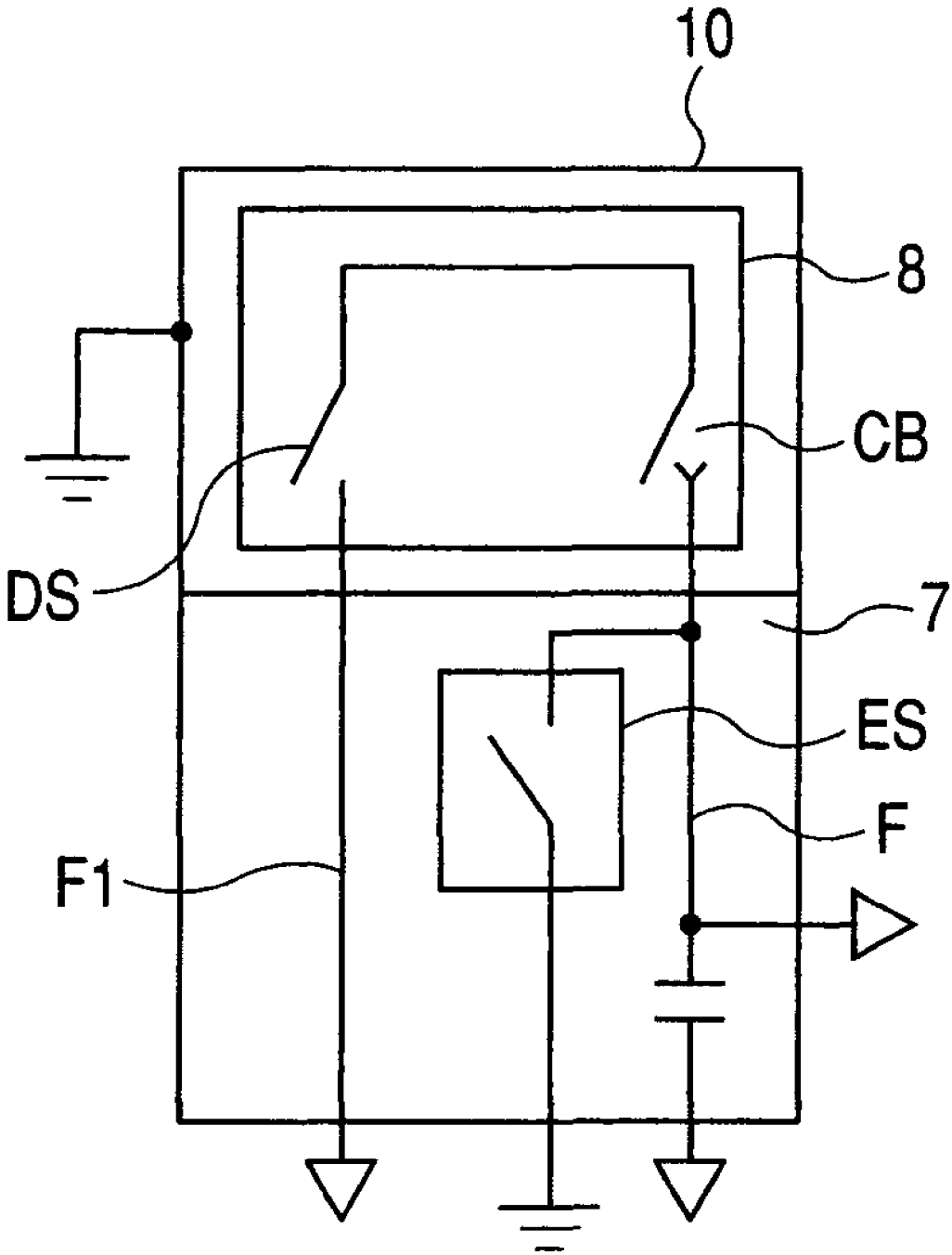
FIG. 7 is an electric schematic circuit diagram of a cubicle-type switching apparatus configured in the other embodiment of the inventive vacuum switchgear.

FIGS. 5 to 7 illustrate another embodiment of a vacuum switchgear according to the present invention. FIG. 5 is a longitudinal front view illustrating the other embodiment of the inventive vacuum switchgear. FIG. 6 is a side view in which part of the other embodiment of the inventive vacuum switchgear shown in FIG. 1 is omitted. FIG. 7 is an electric schematic circuit diagram of a cubicle-type switching apparatus configured in the other embodiment of the inventive vacuum switchgear. The parts in these drawings are assigned the same reference numerals as the identical or equivalent parts in FIGS. 1 to 4.

First, the cubicle-type switching apparatus in FIG. 7 generally comprises a vacuum switch which is constituted a circuit breaker (CB), a disconnecting switch (DS), an earth switch (ES), a feeder conductor (F) connected to a fixed electrode of the circuit breaker (CB), and a branching bus (F1) connected to a fixed electrode of the disconnecting switch (DS). The feeder conductor (F), branching bus (F1), and earth switch (ES) are molded with resin. A vacuum container 8 is placed on the mold section 7. The vacuum container 8 includes the circuit breaker (CB) and the disconnecting switch (DS). The outer periphery or surface of the vacuum container 8 is covered by an insulating mold case 10 with resin.

The other embodiment of the inventive vacuum switchgear that constitutes the cubicle-type switching apparatus described above will be described in detail with reference to FIGS. 5 and 6.

The feeder conductor (F) 3 connected to the fixed electrode 12 of the circuit breaker (CB) 1, the branching bus (F1) 3A connected to the fixed electrode 22 of the disconnecting switch (DS) 2, the earth switch (ES) 4 connected to the feeder conductor 3, and the voltage dividers 6 provided on the feeder conductor 3 are molded with resin and constitute a mold section 7, as shown in FIG. 5. The earth switch 4 has a solid insulating tube 41 made of, for example, ceramic and kept under vacuum, a fixed electrode 42 fixed at the lower part of the fixed insulating tube 41 and connected to the feeder conductor 3, and a movable electrode 44 disconnectably connected to the fixed electrode 42 at the upper part of the solid insulating tube 41 through a bellows 43. The movable electrode 44 of the earth switch 4 is made movable by an earth switch opening/closing mechanism 45 that comprises a rod, a link, and the like. The movable electrode 44 of the earth switch 4 is connected to an earth bus 46.

A vacuum container 8 made of stainless or another material is disposed on the mold section 7. The vacuum container 8 has a two-part structure that comprises a lower part 8A and an upper part 8B. The lower part 8A of the vacuum container 8 is disposed on the mold section 7 through a solid insulator 30 made of, for example, ceramic. The outer periphery or surface of the lower part 8A and upper part 8B of the vacuum container 8 are covered by an insulating mold case 10 with resin that is formed integrally with the mold section 7.

After the conductor, bellows, contacts, and other constituting parts are brazed in the lower part 8A of the vacuum container 8, the upper part 8B is fitted onto the lower part 8A and then the joint part is brazed. Finally, the vacuum container is vacuum sealed.

The circuit breaker 1 disposed in the vacuum container 8 has a fixed electrode 12 connected to the feeder conductor 3, a movable electrode 13 can be connected to and disconnected from the fixed electrode 12, and an insulating rod 15 connected to the movable electrode 13 through a bellows 14. The insulating rod 15 is connected to a circuit breaker opening/closing mechanism 17 for the circuit breaker that comprises a rod, a link, and the like. The bellows 14 has a bag shape and has less sealing portions, increasing the reliability for vacuum.

The disconnecting switch 2 disposed in the vacuum container 8 has a fixed electrode 22 connected to the branching bus 3A brought into the vacuum container 8, a movable electrode 23 connectable to and disconnectable from the fixed electrode 22, an insulating rod 25 connected to the movable electrode 23 through a bellows 24, and an arc shield 26 disposed on the inner surface of the vacuum container 8. The insulating rod 25 is connected to a load break switch opening/closing mechanism 27 for the disconnecting switch that comprises a rod, a link, and the like. As with the above bellows 14, the bellows 24 has a bag shape and has less sealing portions, increasing the reliability for vacuum hermeticity.

The arc shield 26 has the same electric potential as the vacuum container 8. Therefore, the arc shield 26 prevents metallic particles released from the electrode of the disconnecting switch 2 at the time of current shutdown from adhering to the electrode and thereby prevents the withstand voltage from being reduced. Furthermore, when the electrodes of the disconnecting switch 2 and circuit breaker 1 are both turned off, the insulation reliability at the time of disconnection of the disconnecting switch 2 is increased.

The movable electrode 13 for the circuit breaker 1 and the movable electrode 23 for the disconnecting switch 2 are interconnected by a flexible conductor 28. The flexible conductor 28 is fixed to the movable electrodes 13, 23 by screwing and brazing. When the moving electrode 13, 23 moves, the flexible conductor 28 generates a return force in the lateral direction in FIG. 1. Since the flexible conductor 28 is fixed by screws to resist to the return force, so that work involved in the brazing is simplified.

A side of the feeder conductor 3 opposite to its fixed electrode is a cable connection terminal brought to the lower part of the vacuum container 8. A side of the branching bus 3A opposite to its fixed electrode is a bus connection terminal horizontally brought to the lower part of the vacuum container 8. Bushings of these terminals are provided at the lower part of the vacuum container 8.

Next, the operation of another embodiment of the inventive vacuum switchgear will be described in detail with reference to FIGS. 5 and 6.

In the circuit breaker 1, the circuit breaker opening/closing mechanism 27 is operated according to a detection signal for an overcurrent, shortcircuit, ground fault, or other failure that is detected on the load side by a detecting means. The movable electrode 13 is then disconnected from the fixed electrode 12 to open the connection circuit.

The disconnecting switch 2 is operated by its opening/closing mechanism 27, and disconnects the movable electrode 23 from the fixed electrode 22 to disconnect the connection circuit. This embodiment uses a phase separation construction. For three phases, another unit construction described above may be provided.

Even if a ground fault occurs in the earth switch 4, the ground fault current is automatically shut down within one cycle, suppressing the ground fault from spreading.

Since the vacuum container 8 is constructed as two parts, sealing can be done easily by brazing the joint portion of the lower part 8A and upper part 8B of the vacuum container 8.

According to the above embodiment of the present invention, the vacuum container 8 including the circuit breaker 1 and disconnecting switch 2 is disposed on the mold section 7, so the electric potential of the vacuum container 8 is a floating voltage, thereby increasing the safety and reliability of the vacuum container 8 against ground faults.

The earth switch 4 is disposed outside the vacuum container 8, that is, in the mold section 7, so the structures of the circuit breaker 1, the disconnecting switch 2, and the like in the vacuum container 8 can be simplified, and the vacuum container can be made compact.

Since the main elements of the mold section 7 are the feeder conductors 3 and the branching buses (F1s) 3A, the molding cost can be reduced and thereby the entire manufacturing cost can also be reduced.

In the above embodiment, the insulating mold case 10 provided on the outer periphery or surface of the vacuum container 8 is used to prevent ground faults. The insulating mold case is preset so that it can withstand an increase in electric potential that is caused by arc generation at the time of current shutdown by the circuit breaker 1. When the outer surface of the insulating mold case 10 is coated with paint having conductive material, so the electric potential of the vacuum container 8 is fixed to the ground potential, even if a person touches directly the insulating mold case 10, the person can be kept safety.

Figure 8:
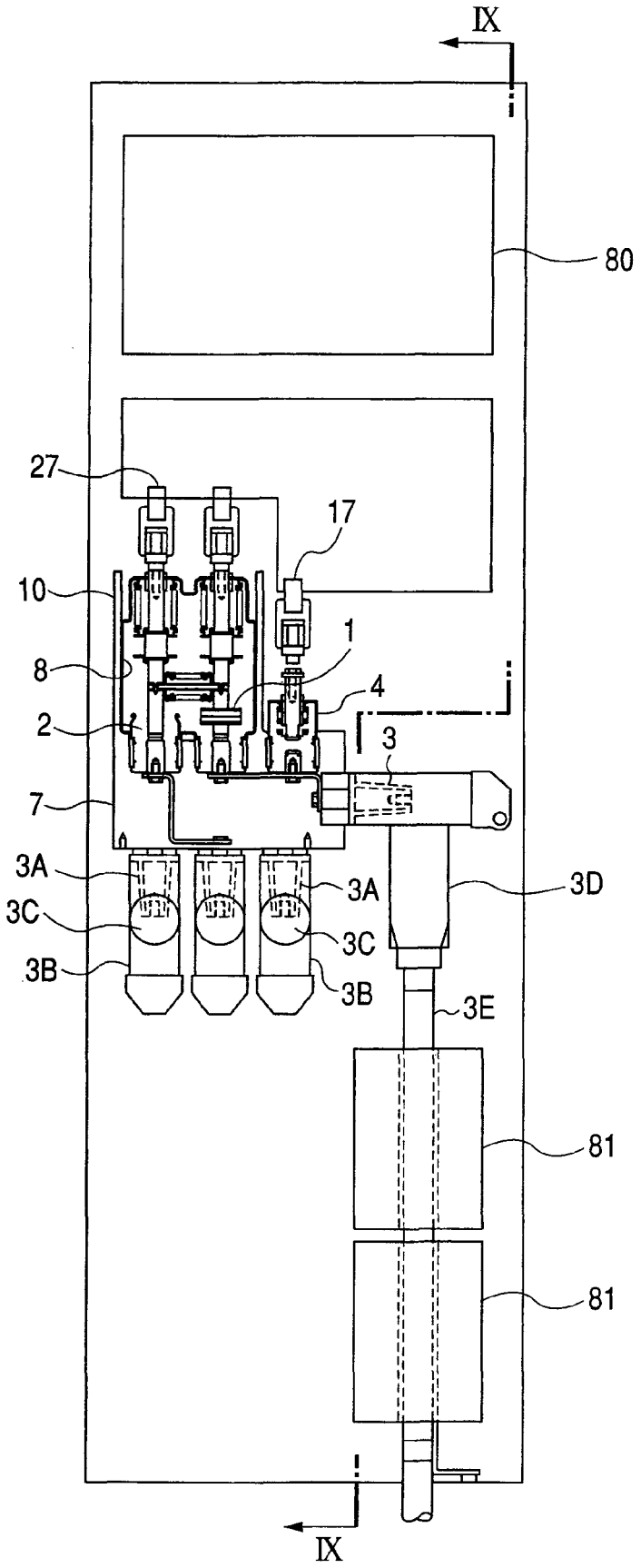
FIG. 8 is a front view of an exemplary switching apparatus having the other embodiment of the inventive vacuum switchgear shown in FIG. 5.
Figure 9:
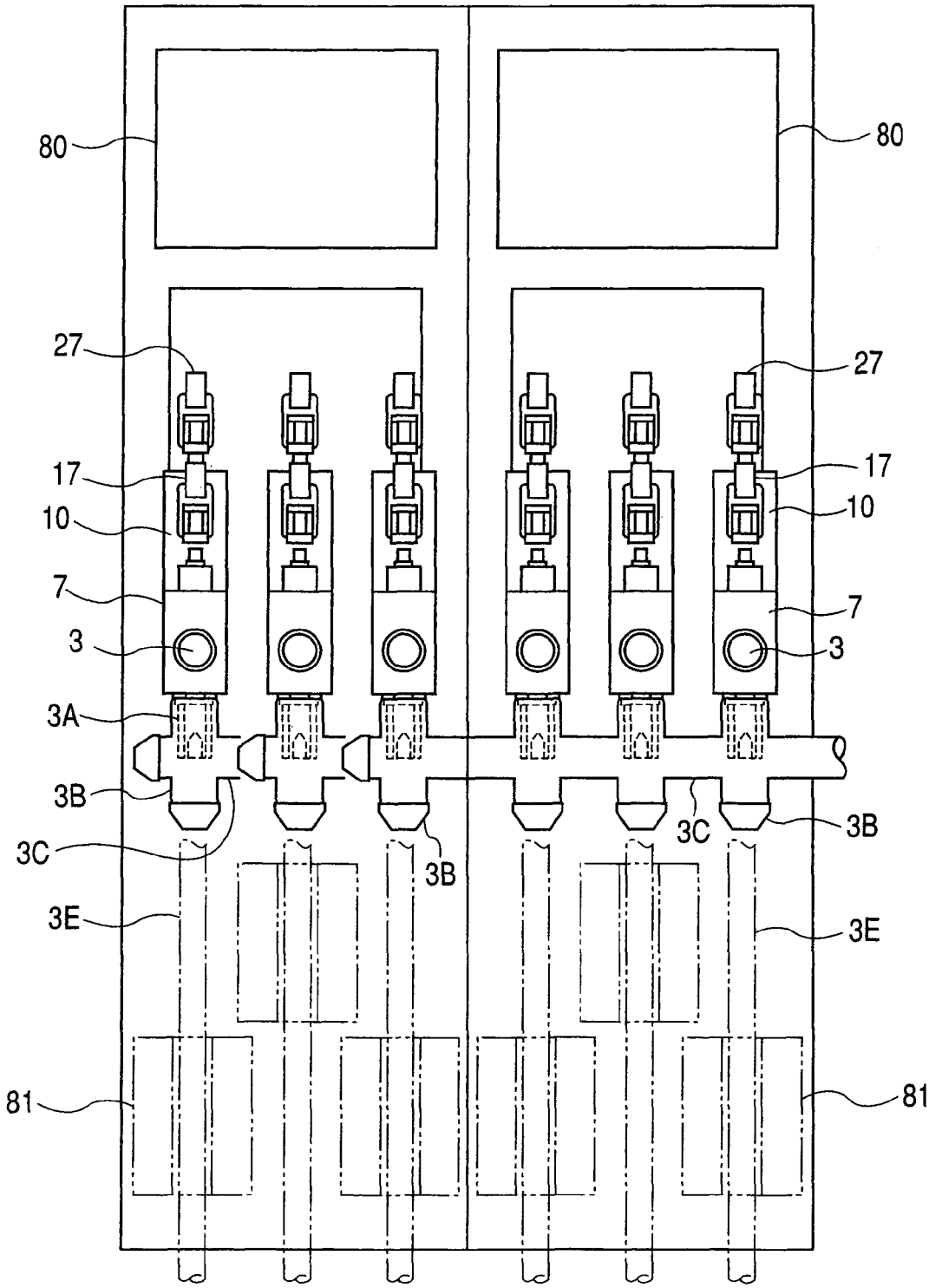
FIG. 9 is a cross-sectional view showing section IX-IX of the switching apparatus in FIG. 8.

FIGS. 8 and 9 show an exemplary switching apparatus having another embodiment of the vacuum switchgear shown in FIGS. 5 and 6. FIG. 8 is a front view of the switching apparatus, and FIG. 9 is a cross-sectional view showing section IX-IX in FIG. 8. The parts in these drawings are assigned the same reference numerals as the identical parts in FIGS. 5 to 7. A protective relay device 80 is provided above an opening/closing mechanism 17 for the circuit breaker and another opening/closing mechanism 27 for the disconnecting switch 2.

Buses 3A extending downward from the mold section 7 are each provided with a bus-side bushing 3B. These bus-side bushings 3B are mutually displaced as shown in FIGS. 5 and 9 and interconnected by a horizontal bus-side bushing 3C for each phase.

Feeder conductors 3 extend horizontally from the mold section 7 as shown in FIGS. 5 and 8. A T-shaped cable head 3D is attached to each feeder conductor 3 as shown in FIG. 8, and a conductor 3E extends downward from the T-shaped cable head. The conductor 3E is provided with a current transformer 81.

According to this embodiment, as in the above embodiments, the electric potential of the vacuum container 8 is a floating voltage, thereby increasing the safety and reliability of the vacuum container 8 against ground faults. The earth switch 4 is disposed outside the vacuum container 8, that is, in the mold section 7, so the structures of the circuit breaker 1, the disconnecting switch 2, and the like in the vacuum container 8 are simplified, and the vacuum container can be made compact. Since the main elements of the mold section 7 are the feeder conductors 3 and the branching buses (F1) 3A, the molding cost can be reduced and thereby the entire manufacturing cost can also be reduced.

Since the bus-side bushings and feeder-side bushings are disposed at the bottom of the mold section 7, devices for taking countermeasures against internal arc accompanying short-circuits may be disposed there, which simplifies maintenance of these devices.

Furthermore, in this embodiment, a voltage monitor to be connected to the current transformer 81 can be provided on the feeder side, and an interlock can also be provided so as not to permit the ground switch 4 to be turned on when the voltage monitor detects that a voltage is present. If a vacuum leakage occurs in the circuit breaker 1 or disconnecting switch 2, for example, a voltage develops on the feeder side even when the circuit breaker 1 and disconnecting switch 2 are both shut off. If the disconnecting switch 2 is turned on in this state, a ground fault will occur. The interlock suppresses such ground faults.

In the embodiment described above, an electrode which can shut off a short-circuit current such as, for example, a spiral electrode or vertical electric field-type electrode, may be used to the electrode of the ground switch 4.

Figure 10:
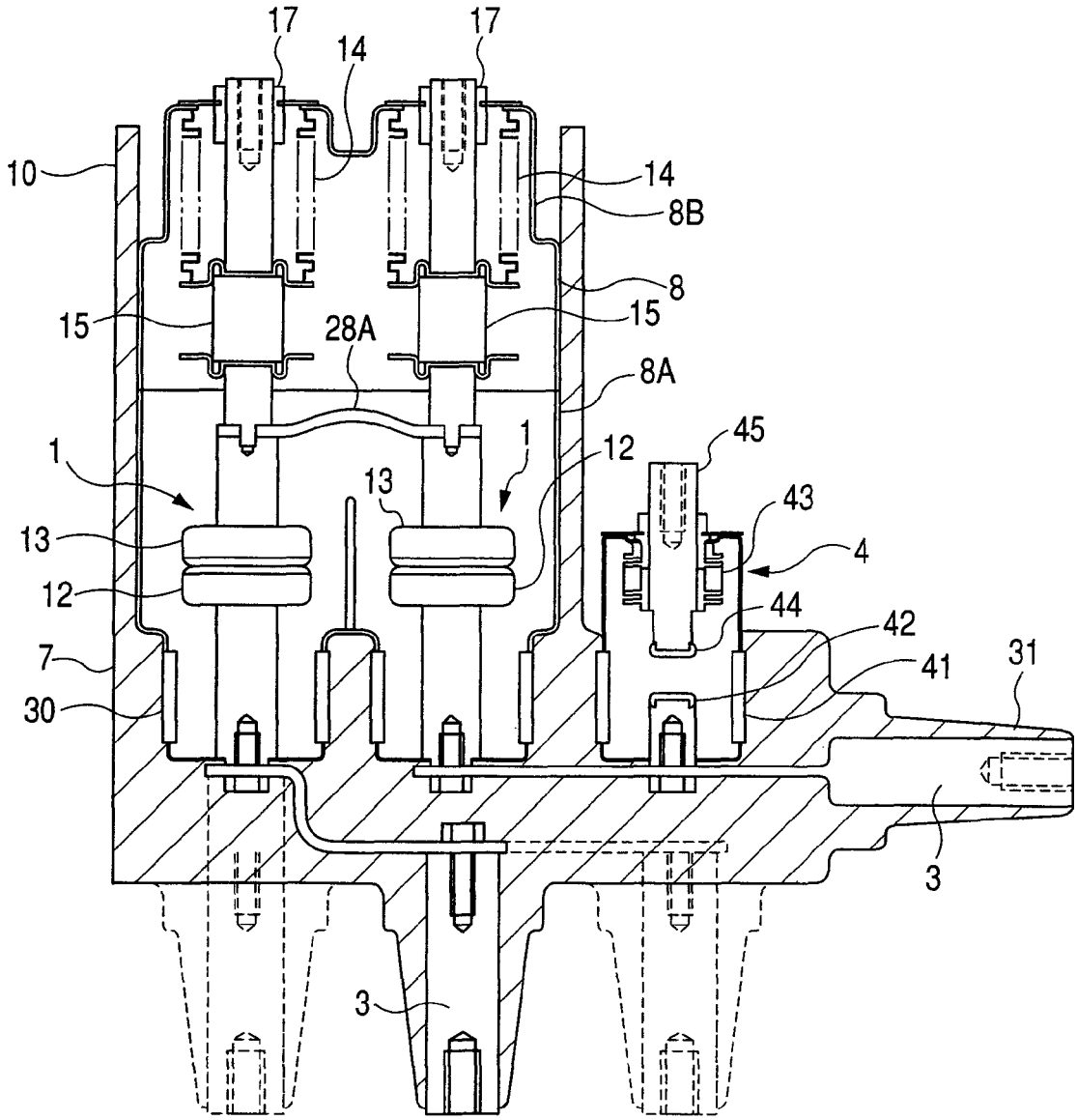
FIG. 10 is a longitudinal front view illustrating still another embodiment of the inventive vacuum switchgear.

FIG. 10 is a longitudinal front view illustrating another embodiment of the inventive vacuum switchgear. The parts in this drawing are assigned the same reference numerals as the identical or equivalent parts in FIG. 5. The vacuum switchgear has a plurality of circuit breakers 1 in the vacuum container 8. The electrodes 13 of the plurality of circuit breakers 1 are operated concurrently to enable the use of turned-on, turned-off, and disconnected positions.

In this embodiment, as in the embodiments described above, the conductor 3 connected to the fixed electrode 12 of the circuit breaker 1, the earth switch 4 connected to the conductor 3, and the like are resin molded to the mold section 7. A vacuum container 8 is provided on the mold section 7. By this structure, the electric potential of the vacuum container 8 is a floating voltage, thereby increasing the safety and reliability of the vacuum container 8 against ground faults. The earth switch 4 is disposed outside the vacuum container 8, that is, in the mold section 7, so the vacuum switch structure of the circuit breaker 1 can be simplified, and the vacuum container 8 can be made compact. Since the main elements of the mold section 7 are the conductors 3, the molding cost can be reduced and thereby the entire manufacturing cost can also be reduced.

In this embodiment, the movable electrodes 13 of the each circuit breakers 1 are operated concurrently. This eliminates the need to use a flexible conductor as the conductor for connecting the movable electrodes 13. A copper sheet 28A is sufficient. In addition, the conductors are derived at a small pitch, contributing to making the vacuum switch compact.

What is claimed is:

1. A vacuum switchgear, comprising:

a switch having a fixed electrode and a movable electrode, the movable electrode being connectable to and disconnectable from the fixed electrode, the switch including a circuit breaker and disconnecting switch;

a conductor connected to the fixed electrode of the switch;

a bus connected to the switch;

a mold section in which the conductor and bus are molded with a resin;

a vacuum container that accommodates the circuit breaker and the disconnecting switch, and the vacuum container is made of metal; and a solid insulating material disposed between the mold section and the vacuum container and that covers the vacuum container, wherein the conductor and the bus are both disposed on a side adjacent to the vacuum container, and the vacuum container is disposed on the mold section.

2. A vacuum switchgear, comprising:

a switch having a fixed electrode and a movable electrode, the movable electrode being connectable to and disconnectable from the fixed electrode, the switch including a circuit breaker and disconnecting switch;

a conductor connected to the fixed electrode of the switch;

a bus connected to the switch;

a ground switch;

a mold section in which the conductor and bus are molded with a resin;

a vacuum container that accommodates the circuit breaker and the disconnecting switch and the vacuum container is made of metal; and a solid insulating material disposed between the mold section and the vacuum container and that covers the vacuum container, wherein the conductor and the bus are both disposed on a side adjacent to the vacuum container, and the vacuum container is disposed on the mold section.

3. A vacuum switchgear, comprising:

switches, each having a fixed electrode and a movable electrode, the movable electrode being connectable to and disconnectable from the fixed electrode, one of the switches functioning as a circuit breaker, the other functioning as a load break switch;

conductors connected to the fixed electrodes of the circuit breaker and the load break switch;

buses connected to the switches;

ground switches;

a mold section in which the conductors and buses are molded with a resin;

a vacuum container that accommodates the circuit breaker and the load break switch, the vacuum container being made of metal; and a solid insulating material disposed between the mold section and the vacuum container and that covers the vacuum container, wherein the conductors and the buses are both disposed on a side adjacent to the vacuum container, and the vacuum container is disposed on the mold section.

4. A vacuum switchgear, comprising:

switches, each having a fixed electrode and a movable electrode, the movable electrode being connectable to and disconnectable from the fixed electrode, one of the switches functioning as a circuit breaker, the other functioning as a load break switch;

conductors connected to the fixed electrodes of the circuit breaker and the load break switch;

buses connected to the switches;

ground switches;

a mold section in which the conductors and buses are molded with a resin;

a vacuum container that accommodates the circuit breaker and the load break switch, the vacuum container being made of metal; and a solid insulating material disposed between the mold section and the vacuum container and that covers the vacuum container, wherein the conductors and the buses are both disposed on a side adjacent to the vacuum container, and the vacuum container is disposed on the mold section.

5. The vacuum switchgear according to claim 4, wherein a resin member is provided on an outer periphery of the vacuum container.

6. The vacuum switchgear according to claim 5, wherein conductive paint is provided on an outer periphery of the resin member.

7. A vacuum switchgear, comprising:

switches, each having a fixed electrode and a movable electrode, the movable electrode being connectable to and disconnectable from the fixed electrode, one of the switches functioning as a circuit breaker, the other functioning as a disconnecting switch;

conductors connected to the fixed electrodes of the circuit breaker and the disconnecting switch;

buses connected to the switches;

ground switches;

a mold section in which the conductors and buses are molded with a resin;

a vacuum container that accommodates the circuit breaker and the disconnecting switch, the vacuum container being made of metal; and a solid insulating material disposed between the mold section and the vacuum container and that covers the vacuum container, wherein the conductors and the buses are both disposed on a side adjacent to the vacuum container, and the conductor and the bus are molded with resin which forms a mold section, and the vacuum container is disposed on the mold section.

8. The vacuum switchgear according to claim 7, wherein a resin member is provided on an outer periphery of the vacuum container.

9. The vacuum switchgear according to claim 7, wherein the vacuum container is a metallic container that is divided vertically into two parts, and a resin member integral with the mold section is provided on an outer periphery of the metallic container.

10. A vacuum switchgear, comprising:

switches, each having a fixed electrode and a movable electrode, the movable electrode being connectable to and disconnectable from the fixed electrode, one of the switches functioning as a circuit breaker, the other functioning as a disconnecting switch;

conductors connected to the fixed electrodes of the circuit breaker and the disconnecting switch;

buses connected to the switches;

ground switches;

a mold section in which the conductors and buses are molded with a resin;

a vacuum container that accommodates the circuit breaker and the disconnecting switch, the vacuum container being made of metal; and a solid insulating material disposed between the mold section and the vacuum container and that covers the vacuum container, wherein the conductors and the buses are both disposed on a side adjacent to the vacuum container, and the vacuum container is disposed on the mold section.

11. A vacuum switchgear, comprising:

switches, each having a fixed electrode and a movable electrode, the movable electrode being connectable to and disconnectable from the fixed electrode;

conductors connected to the fixed electrodes of the switches, one of the switches functioning as a circuit breaker, the other functioning as a disconnecting switch;

ground switches;

buses connected to the switches;

a mold section with which the conductors and buses are molded with a resin;

a vacuum container that accommodates the circuit breaker and the disconnecting switch the vacuum container being made of metal;

a solid insulating material disposed between the mold section and the vacuum container and that covers the vacuum container; and a solid insulator disposed between the conductor connected to the fixed electrode and the vacuum container disposed on the mold section, wherein the conductor and the bus are both disposed on a side adjacent to the vacuum container, and the conductor and the bus are molded with resin which forms a mold section, wherein the vacuum container is disposed on the mold section, and wherein an electric potential of the vacuum container is a floating potential.

* * * * *